US009464337B2

(12) United States Patent
Mukai et al.

(10) Patent No.: US 9,464,337 B2
(45) Date of Patent: Oct. 11, 2016

(54) HIGH STRENGTH STEEL SHEET HAVING EXCELLENT HYDROGEN EMBRITTLEMENT RESISTANCE

(75) Inventors: Yoichi Mukai, Shinagawa-ku (JP); Kouji Kasuya, Kakogawa (JP); Michiharu Nakaya, Kakogawa (JP); Michitaka Tsunezawa, Kakogawa (JP); Fumio Yuse, Kobe (JP); Junichiro Kinugasa, Kobe (JP); Sandra Traint, Linz (AT); Andreas Pichler, Voecklabruck (AT)

(73) Assignees: KABUSHIKI KAISHA KOBE SEIKO SHO, Kobe-shi (JP); VOESTALPINE STAHL GMBH, Linz (AT)

( * ) Notice: Subject to any disclaimer, the term of this patent is extended or adjusted under 35 U.S.C. 154(b) by 1 day.

(21) Appl. No.: 13/375,132

(22) PCT Filed: May 28, 2010

(86) PCT No.: PCT/JP2010/003610

§ 371 (c)(1),
(2), (4) Date: Jan. 24, 2012

(87) PCT Pub. No.: WO2010/137343

PCT Pub. Date: Dec. 2, 2010

(65) Prior Publication Data

US 2012/0132327 A1 May 31, 2012

(30) Foreign Application Priority Data

May 29, 2009 (JP) ..... 2009-130924

(51) Int. Cl.
*C21D 6/00* (2006.01)
*C22C 38/04* (2006.01)
(Continued)

(52) U.S. Cl.
CPC ..... *C21D 9/46* (2013.01); *C21D 8/0205* (2013.01); *C21D 8/0226* (2013.01);
(Continued)

(58) Field of Classification Search
CPC ..... C21D 9/46; C22C 38/02; C22C 38/04; C22C 38/06
USPC ..... 148/660
See application file for complete search history.

(56) References Cited

U.S. PATENT DOCUMENTS 7,438,770 B2 * 10/2008 Yuse et al. ..... 148/320
7,887,648 B2 * 2/2011 Kinugasa et al. ..... 148/333
(Continued)

FOREIGN PATENT DOCUMENTS

EP 1 676 932 7/2006
EP 1 676 933 7/2006
(Continued)

OTHER PUBLICATIONS

Yamada, T., et al., "The Mixed Structure with Bainite and Retained Austenite in a Si—Mn Steel," Nisshin Steel Technical Report, vol. 43, pp. 1-10, (Dec. 1980) (with English abstract).
(Continued)

*Primary Examiner* — Roy King
*Assistant Examiner* — Xiaowei Su
(74) *Attorney, Agent, or Firm* — Oblon, McClelland, Maier & Neustadt, L.L.P.

(57) ABSTRACT

Disclosed is a high strength steel sheet having excellent hydrogen embrittlement resistance. The steel sheet has a tensile strength of 1180 MPa or more, and satisfies the following conditions: with respect to an entire metallographic structure thereof, bainite, bainitic ferrite and tempered martensite account for 85 area % or more in total; retained austenite accounts for 1 area % or more; and fresh martensite accounts for 5 area % or less (including 0 area %).

16 Claims, 1 Drawing Sheet

(51) Int. Cl.

| | |
|---|---|
| ***C22C 38/08*** | (2006.01) |
| ***C22C 38/12*** | (2006.01) |
| ***C22C 38/16*** | (2006.01) |
| ***C22C 38/00*** | (2006.01) |
| ***C22C 38/38*** | (2006.01) |
| ***C21D 9/46*** | (2006.01) |
| ***C21D 8/02*** | (2006.01) |
| ***C22C 38/02*** | (2006.01) |
| ***C22C 38/06*** | (2006.01) |
| ***C22C 38/14*** | (2006.01) |

(52) U.S. Cl.
CPC ..... *C21D 8/0236* (2013.01); *C21D 8/0252* (2013.01); *C22C 38/001* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *C22C 38/38* (2013.01); *C21D 2211/002* (2013.01); *C21D 2211/005* (2013.01)

(56) References Cited

U.S. PATENT DOCUMENTS

| | | | | |
|---|---|---|---|---|
| 2006/0137768 | A1* | 6/2006 | Yuse et al. | 148/320 |
| 2008/0251161 | A1 | 10/2008 | Kashima et al. | |
| 2009/0053096 | A1 | 2/2009 | Miura et al. | |
| 2009/0238713 | A1 | 9/2009 | Kinugasa et al. | |
| 2010/0080728 | A1 | 4/2010 | Ikeda et al. | |

FOREIGN PATENT DOCUMENTS

| | | | |
|---|---|---|---|
| EP | 1 865 085 | | 12/2007 |
| JP | 1-272720 | | 10/1989 |
| JP | 2002 097551 | | 4/2002 |
| JP | 2004 332099 | | 11/2004 |
| JP | 2006 207016 | | 8/2006 |
| JP | 2006 207017 | | 8/2006 |
| JP | 2006 207018 | | 8/2006 |
| JP | 2006 283131 | | 10/2006 |
| JP | 2007 197819 | | 8/2007 |
| JP | 2008 169475 | | 7/2008 |
| JP | 2008169475 A | * | 7/2008 |
| WO | WO 2007/077933 A1 | | 7/2007 |

OTHER PUBLICATIONS

International Search Report Issued Aug. 24, 2010 in PCT/JP10/003610 Filed May 28, 2010.

Notification of Transmittal of Translation of the International Preliminary Report on Patentability and Written Opinion issued Dec. 22, 2011 in patent application No. PCT/JP2010/003610 filed May 28, 2010.

Office Action issued Apr. 1, 2013, in Chinese patent application No. 201080023659.9 (w/English translation).

Extended Search Report issued Jul. 19, 2013, in European patent application No. 10780303.

Office Action issued Jul. 9, 2013, in Japanese patent application No. 2009-130924 (w/English translation).

Office Action issued Aug. 12, 2013 in Korean Patent Application No. 10-2011-7030071 (with English-language translation).

* cited by examiner

HIGH STRENGTH STEEL SHEET HAVING EXCELLENT HYDROGEN EMBRITTLEMENT RESISTANCE

TECHNICAL FIELD

The present invention relates to a high strength steel sheet usable as a steel sheet for automobiles and transport airplanes, and more specifically to a steel sheet having a tensile strength of 1180 MPa or more.

BACKGROUND ART

In order to attain higher fuel economy in automobiles, transport airplanes, etc., it is desired to reduce an empty weight of an automobile or transport airplane. A technique of using a high strength steel sheet and reducing a thickness thereof is effective for the weight reduction. In particular, automobiles are required to ensure collision safety. For example, structural components such as a pillar, and reinforcing components such as a bumper and an impact beam, are required to further increase the strength thereof. However, in general, as the strength of a steel sheet is increased, ductility will be deteriorated, resulting in poor workability. Therefore, there is a need for a steel sheet capable of satisfying both high strength and high ductility.

As a steel sheet having both high strength and high ductility, great interest has been shown in a TRIP (Transformation Induced Plasticity) type steel sheet. As one example thereof, there has been known a TBF steel sheet which comprises: bainitic ferrite as its parent phase; and retained austenite (hereinafter occasionally denoted as "retained γ") (see, for example, the following Non-Patent Document 1). In the TBF steel sheet, high strength is obtained based on hard bainitic ferrite, and excellent ductility is obtained based on fine retained γ existing in boundaries of the bainitic ferrite.

Meanwhile, a steel sheet for use in automobiles and transport airplanes is also required to be resistant to the occurrence of delayed fracture due to hydrogen embrittlement (hereinafter referred to occasionally as "hydrogen embrittlement resistance"). The delayed fracture means a phenomenon that hydrogen generated in a corrosive environment or hydrogen in the atmosphere diffuses into defective areas, such as dislocations, holes and grain boundaries, in the steel sheet, to embrittle the defective areas and cause deterioration in ductility and rigidity of the steel sheet, and thereby fracture will occur under a condition that static stress causing no plastic deformation is applied to the steel sheet.

As a technique for improving hydrogen embrittlement resistance of the TBF steel sheet comprising retained γ, the following Patent Documents 1 to 5 have been known. Among them, the Patent Document 1 discloses a technique for improving hydrogen embrittlement resistance of a high-strength thin steel sheet which comprises a main phase consisting of bainite and bainitic ferrite, and a second phase consisting of austenite, with the remainder being ferrite and/or martensite, and has a tensile strength of 800 MPa or more. This Document includes a description mentioned that, in order to improve the hydrogen embrittlement resistance, the strength and composition of the steel sheet are adjusted to control a deposit serving as a hydrogen trap site, and the composition of the steel sheet is adjusted to reduce a rate of hydrogen penetration into the steel sheet.

The Patent Documents 2 to 5 disclose techniques which were previously proposed by the applicant of this application. Metallographic structures of steel sheets disclosed in each of these Documents comprise 1 area % or more of retained γ, and 80 area % or more of a total of bainitic ferrite and martensite. These Documents include a description mentioned that the parent phase of the steel sheet may be formed in a two-phase structure of bainitic ferrite and martensite to reduce origins of intergranular fracture, and retained γ is formed in a lath-like configuration to enhance a hydrogen trapping capability to allow hydrogen to become harmless so as to improve the hydrogen embrittlement resistance.

The steel sheet for automobiles and transport airplanes is required to satisfy both high strength and high ductility, as mentioned above. Particularly as for strength, it has recently been required to satisfy a tensile strength of 1180 MPa or more. However, if the tensile strength is increased to 1180 MPa or more, the delayed fracture due to hydrogen embrittlement is more likely to occur. Therefore, in the Patent Documents 2 to 4, the applicant disclosed and proposed a technique intended for a high strength steel sheet having a tensile strength of 1180 MPa or more and designed to improve the hydrogen embrittlement resistance, and obtained a certain level of effect. However, there is a need for further improving the hydrogen embrittlement resistance.

LIST OF PRIOR ART DOCUMENTS

Patent Documents

Patent Document 1: JP 2004-332099A
Patent Document 2: JP 2006-207016A
Patent Document 3: JP 2006-207017A
Patent Document 4: JP 2006-207018A
Patent Document 5: JP 2007-197819A

Non-Patent Documents

Non-Patent Document 1: NISSEN STEEL TECHNICAL REPORT, Vol. 43, December, 1980, pp. 1-10

SUMMARY OF THE INVENTION

The present invention has been made in view of the above circumstances, and an object thereof is to provide a high strength steel sheet having a tensile strength of 1180 MPa or more while ensuring excellent hydrogen embrittlement resistance. It is another object of the present invention to provide a method of producing the high strength steel sheet.

According to one aspect of the present invention, there is provided a high strength steel sheet having excellent hydrogen embrittlement resistance, wherein the steel sheet has a tensile strength of 1180 MPa or more, and satisfies the following conditions: with respect to an entire metallographic structure thereof, bainite, bainitic ferrite and tempered martensite account for 85 area % or more in total; retained austenite accounts for 1 area % or more; and fresh martensite accounts for 5 area % or less (including 0 area %).

According to another aspect of the present invention, there is provided a method of producing a high strength steel sheet having excellent hydrogen embrittlement resistance. The method comprises: a quenching step of cooling a steel sheet which contains, in terms of mass %, C: 0.15 to 0.25%, Si: 1 to 2.5%, Mn: 1.5 to 3%, P: 0.015% or less, S: 0.01% or less, Al: 0.01 to 0.1%, N: 0.01% or less, and the balance of Fe and inevitable impurities, and which has a temperature equal to or greater than an $Ac_3$ point, down to a temperature T1 satisfying the following formula (1), at an average cooling rate of 10° C./sec or more; and a holding step of holding the steel sheet quenched in the quenching step, at a temperature T2 satisfying the following formula (2), for 300 seconds or more.

$$(Ms \text{ point} - 250° \text{ C.}) \leq T1 \leq Ms \text{ point} \quad (1)$$

$$(Ms \text{ point} - 120° \text{ C.}) \leq T2 \leq (Ms \text{ point} + 30° \text{ C.}) \quad (2)$$

These and other objects, features and advantages of the invention will become more apparent from the following detailed description and drawings.

DESCRIPTION OF EMBODIMENTS

The inventors have been dedicated to studying for improving hydrogen embrittlement resistance of a high strength steel sheet having a tensile strength of 1180 MPa or more, with a focus on a metallographic structure of the steel sheet. As a result, the inventors have accomplished the present invention based on the following findings, after a steel sheet is formed to have a metallographic structure comprising a parent phase consisting of a mixed structure of bainite, bainitic ferrite and tempered martensite, and retained austenite as another structure, so as to enhance ductility on the premise of ensuring a strength of 1180 MPa or more:

(1) the hydrogen embrittlement resistance can be improved while maintaining the premise of a high strength of 1180 MPa or more, by adequately controlling the metallographic structure of the high strength steel sheet, particularly, to suppress fresh martensite to 5 area % or less; and (2) the fresh martensite can be suppressed to 5 area % or less by adequately controlling conditions for quenching and conditions for holding after the quenching to form fresh martensite during the quenching and transform the fresh martensite into tempered martensite through tempering so as to reduce fresh martensite to be newly formed during the holding.

The present invention will now be described in detail.

To begin with, types of metallographic structure characterizing the steel sheet of the present invention will be described. In the present invention, the term "fresh martensite" means a crystal grain in which no iron-based carbide appearing in white exists, among a large number of crystal grains which appear in gray when a nital-etched steel sheet surface is subjected to metallographic observation using a scanning electron microscope. On the other hand, a crystal grain in which iron-based carbide exists is defined as "bainite, bainitic ferrite or tempered martensite" and distinguished from the "fresh martensite". The "fresh martensite" will hereinafter be occasionally denoted as "F/M".

How the "fresh martensite" and the "bainite, bainitic ferrite or tempered martensite" are distinguished from each other in an SEM photograph will be specifically described using a photograph as a substitute for a drawing.

Figure 1:
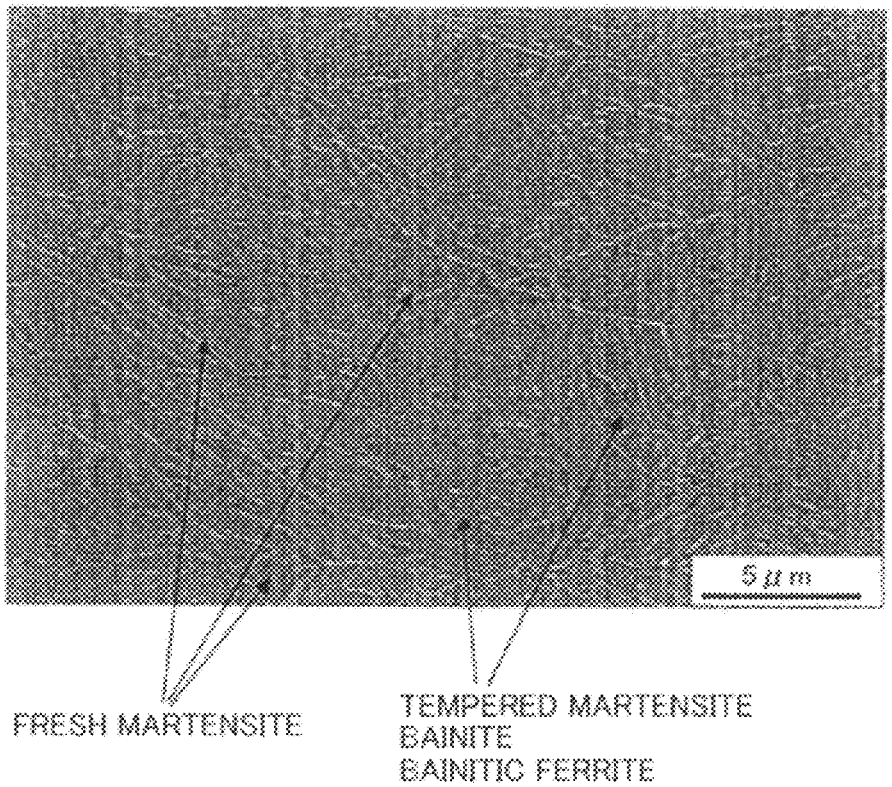
FIG. 1 is a photograph, as a substitute for a drawing, which depicts a metallographic structure of a steel sheet of Sample No. 46 illustrated in Example.
Figure 2:
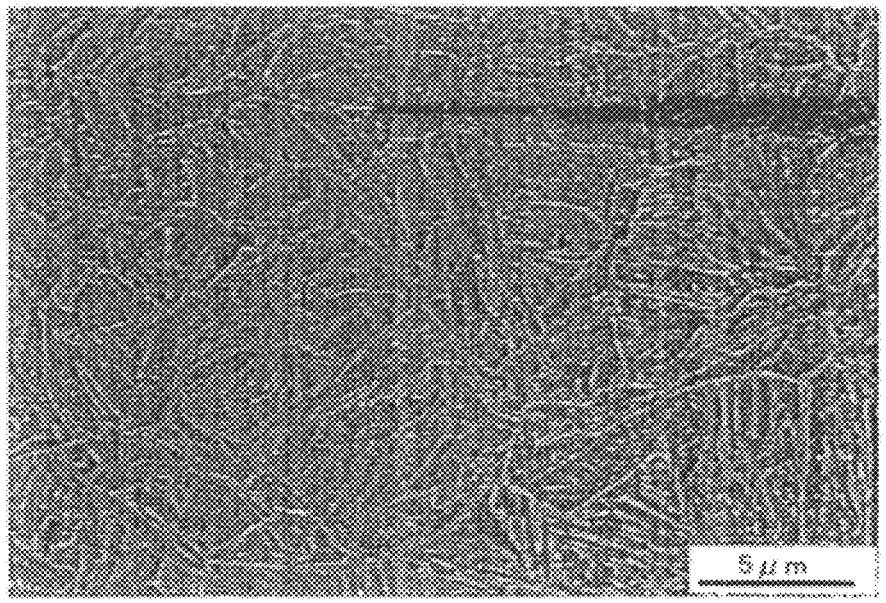
FIG. 2 is a photograph, as a substitute for a drawing, which depicts a metallographic structure of a steel sheet of Sample No. 38 illustrated in Example.

FIG. 1 is a photograph, as a substitute for a drawing, which depicts a metallographic structure of a steel sheet of Sample No. 46 illustrated in Example described below, and FIG. 2 is a photograph, as a substitute for a drawing, which depicts a metallographic structure of a steel sheet of Sample No. 38 illustrated in the Example. When a nital-etched steel sheet surface is subjected to observation using a scanning electron microscope, an aggregate of gray crystal grains is observed in each photograph. In the photograph illustrated in FIG. 1, as well as a crystal grain including a white point or a white line composed of a linear array of continuously connected white points, a crystal grain almost devoid of the white point or the white line is observed. On the other hand, in the photograph illustrated in FIG. 2, a large number of crystal grains each including the white point or the white line are observed, but a crystal grain almost devoid of the white point or the white line is not observed. A result of composition measurement of the white point (or the white line) showed that it is Fe-based carbide.

A difference between a crystal grain devoid of the white point or line, and a crystal grain including the white point or line was checked. As a result, it was proven that the crystal grain devoid of the white point or line is "fresh martensite" transformed from austenite (in this specification, the term "austenite" is occasionally denoted as "γ"), and the crystal grain including the white point or line is "bainite, bainitic ferrite or tempered martensite" transformed from austenite.

Each of bainite, bainitic ferrite and tempered martensite is depicted as a gray crystal grain including the white point or line, so that the three phases could not be distinguished from each other.

A specific feature of the steel sheet according to the present invention will be described below. The steel sheet of the present invention is characterized in that, with respect to an entire metallographic structure thereof, bainite, bainitic ferrite and tempered martensite account for 85 area % or more in total, as a parent phase, and retained austenite accounts for 1 area % or more, as other structure, wherein fresh martensite is suppressed to 5 area % or less (including 0 area %).

The parent phase consisting of bainite, bainitic ferrite and tempered martensite makes it possible to enhance ductility, and the retained austenite makes it possible to further enhance the ductility.

The largest feature of the steel sheet of the present invention is that fresh martensite (F/M) is suppressed to 5 area % or less. The reason for setting this range will be described in connection with a research process.

There has been known a technique of holding a steel sheet after quenching at a given temperature to cause bainite transformation so as to produce a high strength steel sheet, wherein it is considered that an effective way of obtaining higher strength is to perform the holding step at a temperature as low as possible. Therefore, in order to obtain higher strength of a TBF steel sheet, the production is performed at a low holding temperature. As a result, hydrogen embrittlement resistance was significantly deteriorated. Through various studies on this reason, it was proven that F/M is formed in a steel sheet produced at a low holding temperature, and the hydrogen embrittlement resistance is caused by the F/M. As the holding temperature is set to a lower value, a diffusion speed of C becomes lower, so that the bainite transformation becomes less likely to occur, and an austenite phase which has not been transformed during the holding is transformed to form F/M, in the course of cooling to room temperature after completion of the holding. Further, respective hydrogen embrittlement resistances of a steel sheet formed with F/M and a steel sheet formed with no F/M were evaluated. As a result, it was proven that the steel sheet formed with no F/M is more improved in hydrogen embrittlement resistance than the steel sheet formed with F/M.

Then, the inventors studied a relationship between an amount of formation of F/M and the hydrogen embrittlement resistance, in a high strength steel sheet having a tensile strength of 1180 MPa or more. As a result, it was proven that, if F/M falls within 5 area % with respect to the entire metallographic structure of the steel sheet, the hydrogen embrittlement resistance becomes excellent. F/M accounts preferably for 2 area % or less, most preferably for 0 area %.

The parent phase of the steel sheet of the present invention is a mixed structure of bainite, bainitic ferrite and tempered martensite. The parent phase formed as such a mixed structure makes it possible to improve ductility while maintaining the required strength.

With respect to the entire metallographic structure, the mixed structure accounts for 85 area % or more, preferably for 90 area % or more, in total. Bainite, bainitic ferrite and tempered martensite cannot be distinguished from each other in an SEM photograph. Thus, they are defined by a total amount of the mixed structure.

In addition to the mixed structure, the steel sheet of the present invention comprises retained austenite (retained γ). Retained austenite is a structure necessary particularly to enhance ductility. The retained γ is present between bainite laths and between bainitic ferrite laths.

It is necessary that, with respect to the entire metallographic structure, the retained γ accounts for 1 area % or more, preferably for 4 area % or more. An upper limit thereof is, for example, about 13 area %.

The steel sheet of the present invention has a metallographic structure primarily comprising a parent phase consisting of bainite, bainitic ferrite and tempered martensite, and retained γ, wherein F/M is suppressed to 5 area % or less. The steel sheet may additionally comprise other structure inevitably formed during production, within a range where advantageous effects of the steel sheet are not spoiled. For example, the other structure may include ferrite and pearlite. For example, with respect to the entire metallographic structure, the other structure accounts preferably for 10 area % or less, more preferably for 5 area % or less.

The Patent Document 1 discloses a high-strength thin steel sheet which comprises a main phase consisting of bainite and bainitic ferrite, and a second phase consisting of austenite, with the remainder being ferrite and/or martensite, and has a tensile strength of 800 MPa or more. However, a point of dividing martensite into tempered martensite and F/M and suppressing an amount of F/M is not disclosed therein. The steel sheet in which F/M is suppressed to 5 area % or less cannot be found in steel sheets specifically disclosed in Example. As for the steel sheet disclosed in each of the Patent Documents 2 to 5 by the applicant of this application, the metallographic structure thereof overlaps that of the high strength steel sheet of the present invention, in that bainitic ferrite and martensite account for 80 area % or more in total, and retained γ accounts for 1 area % or more. However, the point of dividing martensite into tempered martensite and F/M and suppressing an amount of F/M is not disclosed in these Documents.

A composition of the high strength steel sheet of the present invention will be described below. The composition of the high strength steel sheet of the present invention may be adjusted to allow a tensile strength to become equal to or greater than 1180 MPa based on an alloy composition commonly comprised of a steel sheet for automobiles and transport airplanes. For example, the composition may satisfy the following conditions: C: 0.15 to 0.25%; Si: 1 to 2.5%; Mn: 1.5 to 3%; P: 0.015% or less (except for 0%); S: 0.01% or less (except for 0%); Al: 0.01 to 0.1%; and N: 0.01% or less (except for 0%). The reasons for setting the above ranges are as follows.

C (carbon) is an element which is useful for increasing the strength of a steel sheet. In addition, C is an effective element for formation of retained γ. In view of bringing out the above functions, a content of C is preferably set to 0.15% or more. The content of C is set more preferably to 0.17% or more, still more preferably to 0.19% or more. However, if C is excessively contained, weldability and corrosion resistance will be deteriorated. Thus, the content of C is preferably set to 0.25% or less. More preferably, the content of C is set to 0.23% or less.

Si (silicon) is an element which contributes to an increase in strength of steel, as a solid solution strengthening element. In addition, Si is an element capable of suppressing formation of carbide to effectively function to form retained γ. In view of bringing out the above functions, a content of Si is preferably set to 1% or more. The content of Si is set more preferably to 1.2% or more, still more preferably to 1.4% or more. However, if Si is excessively contained, a scale will be significantly formed to cause a scale trace in a surface of a steel sheet, during hot rolling, so that a surface texture is likely to become worse. Moreover, pickling performance is likely to be deteriorated. Thus, the content of Si is preferably set to 2.5% or less. The content of Si is set more preferably to 2.3% or less, still more preferably to 2% or less.

Mn (manganese) is an element capable of enhancing quenchability to contribute to an increase in strength of a steel sheet. In addition, Mn is an effective element for stabilizing austenite to form retained γ. In view of bringing out the above functions, a content of Mn is preferably set to 1.5% or more. The content of Mn is set more preferably to 1.7% or more, still more preferably to 2% or more. However, if Mn is excessively contained, segregation will occurs, so that workability is likely to be deteriorated. Thus, the content of Mn is preferably set to 3% or less. The content of Mn is set more preferably to 2.8% or less, still more preferably to 2.6% or less.

P (phosphorus) is an element which is inevitably contained, and apt to promote intergranular embrittlement through segregation at grain boundaries. Thus, the content of P is preferably set to 0.015% or less. It is recommended to reduce the content of P as much as possible. The content of P is set more preferably to 0.013% or less, still more preferably to 0.01% or less.

S (sulfur) is an element which is inevitably contained as with P, and apt to promote a steel sheet to absorb hydrogen in a corrosive environment. Thus, the content of S is preferably set to 0.01% or less. It is desirable to minimize the content of S. Specifically, it is set more preferably to 0.008% or less, still more preferably to 0.005% or less.

Al (aluminum) is an element which functions as a deoxidizing agent. In view of bringing out the function, a content of Al is preferably set to 0.01% or more. The content of Al is set more preferably to 0.02% or more, still more preferably to 0.03% or more. However, if Al is excessively contained, a large amount of inclusions such as alumina will be formed in a steel sheet, so that workability is likely to be deteriorated. Thus, the content of Al is preferably set to 0.1% or less. The content of Al is set more preferably to 0.08% or less, still more preferably to 0.05% or less.

N (nitrogen) is an element which is inevitably contained. If N is excessively contained, a nitride will be formed, which causes deterioration in workability. Particularly, in cases where B (boron) is contained in steel, N is combined with B to form a BN precipitate, which hinders a quenchability enhancing function of B. Thus, the content of N is preferably set to 0.01% or less. The content of N is set more preferably to 0.008% or less, still more preferably to 0.005% or less.

The steel sheet of the present invention satisfies the above composition condition, and the remainder is iron and inevitable impurities.

As other element, the steel sheet of the present invention may contain:

(A) Cr: 1% or less (except for 0%) and/or Mo: 1% or less (except for 0%);

(B) B: 0.005% or less (except for 0%);

(C) Cu: 0.5% or less (except for 0%) and/or Ni: 0.5% or less (except for 0%);

(D) Nb: 0.1% or less (except for 0%) and/or Ti: 0.1% or less (except for 0%); and/or (E) one or more selected from the group consisting of Ca: 0.005% or less (except for 0%), Mg: 0.005% or less (except for 0%) and REM: 0.01% or less (except for 0%).

The reasons for setting the above ranges are as follows.

(A) Cr (chromium) and Mo (molybdenum) are elements each capable of enhancing quenchability to function to increase the strength of a steel sheet. They may be used independently or may be used in combination.

Cr is an element which has a function of increasing temper softening resistance, and a function of suppressing a reduction in strength during tempering of F/M, so that it effectively functions to obtain higher strength of a steel sheet. In addition, Cr is an element capable of preventing hydrogen from penetrating into a steel sheet, and contributing to improvement in hydrogen embrittlement resistance because a Cr-containing precipitate serves as a hydrogen trapping site. In view of bringing out the above functions, a content of Cr is preferably set to 0.01% or more. The content of Cr is set more preferably to 0.1% or more, still more preferably to 0.3% or more. However, if Cr is excessively contained, ductility and workability will be deteriorated. Thus, the content of Cr is preferably set to 1% or less. The content of Cr is set more preferably to 0.9% or less, still more preferably to 0.8% or less.

On the other hand, Mo is an element capable of stabilizing austenite to effectively function to form retained γ. In addition, Mo has a function of preventing hydrogen from penetrating into a steel sheet to improve the hydrogen embrittlement resistance. In view of bringing out the above functions, a content of Mo is preferably set to 0.01% or more. The content of Mo is set more preferably to 0.05% or more, still more preferably to 0.1% or more. However, if Mo is excessively contained, workability will be deteriorated. Thus, the content of Mo is preferably set to 1% or less. The content of Mo is set more preferably to 0.7% or less, still more preferably to 0.5% or less.

In cases where Cr and Mo are used in combination, a total content of Cr and Mo is preferably set to 1.5% or less.

(B) B (boron) is an element capable of enhancing quenchability to effectively function to increase the strength of a steel sheet. In view of bringing out the function, a content of B is preferably set to 0.0002% or more. The content of B is set more preferably to 0.0005% or more, still more preferably to 0.001% or more. However, if B is excessively contained, hot workability will be deteriorated. Thus, the content of B is preferably set to 0.005% or less. The content of B is set more preferably to 0.003% or less, still more preferably to 0.0025% or less.

(C) Cu (copper) and Ni (nickel) are elements each capable of suppressing generation of hydrogen causing hydrogen embrittlement, and preventing the generated hydrogen from penetrating into a steel sheet, so that they have a function of enhancing the hydrogen embrittlement resistance. In other words, Cu and Ni are elements each capable of enhancing corrosion resistance of a steel sheet itself, and preventing generation of hydrogen due to corrosion of a steel sheet. In addition, these elements have a function of promoting formation of α-FeOOH, as with Ti described below. Based on promoting the formation of α-FeOOH, it becomes possible to prevent generated hydrogen from penetrating into a steel sheet, so that the hydrogen embrittlement resistance can be enhanced even in a harsh corrosive environment. In view of bringing out the above functions, a content of Cu or Ni is set preferably to 0.01% or more, more preferably to 0.05% or more, still more preferably to 0.1% or more. However, if Cu or Ni is excessively contained, workability will be deteriorated. Thus, the content of Cu or Ni is set preferably to 0.5% or less, more preferably to 0.4% or less, still more preferably to 0.3% or less. One of the Cu and Ni may be added singularly to bring out the above functions. In order to make it easy to develop the functions, it is preferable to use Cu and Ni in combination.

(D) Nb (niobium) and Ti (titanium) are elements each functioning to make crystal grains smaller to increase the strength and rigidity of a steel sheet. They may be used independently or may be used in combination.

In view of bringing out the function of Nb, a content of Nb is preferably set to 0.005% or more. The content of Nb is set more preferably to 0.01% or more, still more preferably to 0.03% or more. However, even if Nb is excessively contained, the advantageous effect will be saturated, and a large amount of Nb precipitate will be formed, which causes deterioration in workability. Thus, the content of Nb is preferably set to 0.1% or less. The content of Nb is set more preferably to 0.9% or less, still more preferably to 0.08% or less.

On the other hand, Ti is an element which has a function of promoting the formation of an iron oxide (α-FeOOH) which is considered as a thermodynamically stable one having protective performance, among rusts to be formed in the air, in addition to the above function. Based on promoting the formation of α-FeOOH, it becomes possible to prevent hydrogen from penetrating into a steel sheet, so that the hydrogen embrittlement resistance can be sufficiently enhanced even in a harsh corrosive environment. In addition, the formation of α-FeOOH makes it possible to suppress the formation of β-FeOOH which would otherwise be formed particularly in a chloride environment to cause a negative effect on corrosion resistance (and thus hydrogen embrittlement resistance), so that the hydrogen embrittlement resistance is further enhanced. Further, Ti is an element which has a function of forming TiN to fix N in steel so as to effectively bring out the quenchability enhancing effect from the addition of B. In view of bringing out the above functions, a content of Ti is preferably set to 0.005% or more. The content of Ti is set more preferably to 0.01% or more, still more preferably to 0.03% or more. However, if Ti is excessively contained, a large amount of carbonitride will be precipitated, which is likely to cause deterioration in workability and hydrogen embrittlement resistance. Thus, the content of Ti is preferably set to 0.1% or less. The content of Ti is set more preferably to 0.09% or less, still more preferably to 0.08% or less.

In cases where Nb and Ti are used in combination, a total content of Nb and Ti is preferably set to 0.15% or less.

(E) Ca (calcium), Mg (magnesium) and REM (rare earth metals) are elements each capable of preventing a hydrogen-ion concentration in surface-contacting atmosphere from being increased due to corrosion of a surface of a steel sheet, and suppressing a lowering in pH in the vicinity of the surface of the steel sheet to enhance corrosion resistance of the steel sheet. In addition, these elements have a function of spheroidizing a sulfide in steel to enhance workability. In view of bringing out the above functions, a content of Ca, Mg or REM is set preferably to 0.0005% or more, more preferably to 0.001% or more, still more preferably to 0.003% or more.

However, if Ca, Mg or REM is excessively contained, workability will be deteriorated. Thus, the content of Ca or Mg is preferably set to 0.005% or less. The content of REM is set preferably to 0.01% or less, more preferably to 0.008% or less. One of the Ca, Mg and REM may be contained singularly. Alternatively, two arbitrarily selected from them may be contained, or all of the three elements may be contained.

In the present invention, the REM (rare earth metals) means elements including lanthanoid (15 types of elements from La to Ln), Sc (scandium) and Y (yttrium). Among these elements, it is preferable to contain at least one element selected from the group consisting of La, Ce and Y, and it is more preferable to contain La and/or Ce.

The steel sheet of the present invention contains the above elements, and may additionally contain any other element (such as Pb, Bi, Sb and/or Sn) within a range where advantageous effects of the present invention are not spoiled.

A method for producing the steel sheet of the present invention will be described below. As described above, a technique of holding a steel sheet at a low temperature after quenching may be used for producing a high strength steel sheet, and a technique of increasing a holding time may be used for completing the bainite transformation during holding at a low temperature, to suppress the formation of F/M. However, as a prerequisite to increasing the holding time, it is necessary to make a facility longer, which leads to an increase in cost of the facility. Moreover, if the holding time is increased, productivity will be deteriorated.

As a result of studies, the inventors have found that a metallographic structure of a steel sheet can be adequately controlled while suppressing the formation of E/M, by: subjecting steel satisfying the aforementioned composition condition to hot rolling in a conventional manner and to cold rolling according to need; heating the rolled steel sheet up to a temperature equal to or greater than an $Ac_3$ point; cooling the heated steel sheet down to a temperature T1 satisfying the following formula (1), at an average cooling rate of 10° C./sec or more to quench the steel sheet (quenching process); and holding the cooled steel sheet at a temperature T2 satisfying the following formula (2), for 300 seconds or more (holding process). In the following description, the holding time at the temperature T2 will be occasionally denoted as "t3".

$$(Ms\ \text{point}-250°\ \text{C.}) \leq T1 \leq Ms\ \text{point} \quad (1)$$

$$(Ms\ \text{point}-120°\ \text{C.}) \leq T2 \leq (Ms\ \text{point}+30°\ \text{C.}) \quad (2)$$

Specifically, a steel sheet is heated up to a temperature equal to or greater than the $Ac_3$ point to form a metallographic structure thereof into single-phase austenite. Then, the heated steel sheet is quenched in such a manner that it is supercooled down to a temperature T1 satisfying the formula (1), at an average cooling rate of 10° C./sec or more, so that a transformation from austenite to ferrite is suppressed to allow the metallographic structure of the steel sheet to be formed as a mixed structure of austenite and F/M.

Then, the steel sheet having the mixed structure is held at a temperature T2 satisfying the formula (2), to allow the austenite in the mixed structure to be transformed to bainite (or bainitic ferrite). During the holding, bainite transformation of the supercooled austenite is completed. This makes it possible to prevent the formation of F/M during cooling to room temperature after the holding. In addition, during the holding, F/M can be transformed to tempered martensite. The holding process at the temperature T2 has to be continued for 300 seconds or more. Because the holding time is required to complete the bainite transformation and to increase a carbon concentration in the austenite based on diffusion of carbon caused by the bainite transformation, so as to allow stable retained γ to be formed even at room temperature.

In the holding process (holding step) of the present invention, a part of the austenite is transformed to F/M. However, based on a combination of the supercooling to the temperature T1 and the holding at the temperature T2 for a long time, an amount of the formation of F/M is suppressed to 5 area % or less. Specifically, during the quenching, the heated steel sheet is supercooled down to a temperature T1 ranging from (Ms point−250° C.) to Ms point, so that a part of the γ is transformed to F/M. Thus, an amount of γ (an area ratio of austenite existing in the steel sheet to the entire metallographic structure thereof) at the start of the holding process can be reduced to an amount of γ formed when the steel sheet is heated up to the $Ac_3$ point or more. Therefore, although a part of γ is transformed to F/M during the holding process of the present invention, an amount of the γ before the transformation is originally small, so that an amount of formation of F/M can be reduced.

If the quenching is performed under a condition that a temperature at the end of the cooling of the steel sheet heated up to the $Ac_3$ point or more is set to a value greater than the Ms point, and then the quenched steel sheet is held at a low temperature, the metallographic structure during the quenching is formed as single-phase γ. Thus, during the holding process, bainite (or bainitic ferrite) and F/M will be formed from the single-phase γ. Therefore, an amount of F/M to be contained in a finally obtained steel sheet will be increased to a value greater than 5 area %.

Details of production conditions will be described below. In the present invention, a steel sheet is heated up to the $Ac_3$ point or more. In cases where the heating temperature is below the $Ac_3$ point, even if a two-phase structure of ferrite and austenite is subjected to quenching and then holding, an amount of γ at the start of the holding process becomes excessively small, so that a total amount of bainite, bainitic ferrite and tempered martensite to be contained in a finally obtained steel sheet cannot be ensured, resulting in lack of strength. Moreover, if the amount of γ at the start of the holding process is excessively small, the γ is likely to disappear during the holding process, which causes no formation of retained γ and deterioration in ductility of the steel sheet. Therefore, the heating temperature is set to the $Ac_3$ point or more. An upper limit of the heating temperature may be set to about 950° C.

An average cooling rate from a temperature equal to or greater than the $Ac_3$ point to a temperature T1 satisfying the formula (1) is set to 10° C./sec or more. If the average cooling rate is less than 10° C./sec, ferrite and pearlite are formed from austenite, so that a strength of 1180 MPa or more cannot be ensured. The average cooling rate is set preferably to 15° C./sec or more, more preferably to 20°

C./sec or more. For example, an upper limit of the average cooling rate is set to about 50° C./sec.

A temperature T1 just after quenching from a temperature equal to or greater than the $Ac_3$ point is set in a range of (Ms point−250° C.) to Ms point. If the cooling-end temperature T1 is greater than the Ms point, bainitic ferrite and bainite will be formed from high-temperature austenite, so that a dislocation density is relatively lowered. Moreover, almost no F/M is formed at the end of the cooling, so that almost no tempered martensite exists in a final metallographic structure. This causes a lack of strength of a steel sheet. Therefore, an upper limit of the temperature T1 is set to the Ms point. Preferably, the upper limit of the temperature T1 is set to (Ms point−20° C.). On the other hand, the temperature T1 just after quenching from a temperature equal to or greater than the $Ac_3$ point is below (Ms point−250° C.), a large amount of F/M will be formed from γ during the quenching, and thereby an amount of γ will be relatively reduced. If an amount of γ is excessively small, the γ will disappear during the holding process, which precludes the formation of retained γ, resulting in deterioration of ductility. Therefore, a lower limit of the temperature T1 is set to (Ms point−250° C.). Preferably, the lower limit of the temperature T1 is set to (Ms point−200° C.).

After being cooled to the temperature T1, the steel sheet is held at a temperature T2 ranging from (Ms point−120° C.) to (Ms point+30° C.), for 300 seconds or more. If the holding temperature T2 is greater than (Ms point+30° C.), a bainite crystal grain will be enlarged, and carbide precipitated in a steel sheet will be enlarged. This causes deterioration in strength, so that a tensile strength of 1180 MPa or more cannot be ensured. Therefore, an upper limit of the temperature T2 is set to (Ms point+30° C.). Preferably, the upper limit of the temperature T2 is set to (Ms point+20° C.). On the other hand, if the holding temperature T2 is below (Ms point−120° C.), a progress of the bainite transformation will become slower. Thus, austenite existing in an untransformed state during the quenching remains in a product steel sheet as F/M formed during the holding process, so that the hydrogen embrittlement resistance is deteriorated. Therefore, a lower limit of the temperature T2 is set to (Ms point−120° C.). Preferably, the lower limit of the temperature T2 is set to (Ms point−110° C.).

When a steel sheet is held at the temperature T2, the temperature may be kept constant in a range of (Ms point−120° C.) and (Ms point+30° C.), or may be changed within the range. The range of the temperature T1 partially overlaps the range of the temperature T2. This means that the cooling-end temperature T1 may be identical to the holding temperature T2. Specifically, in cases where the cooling-end temperature T1 is in a range of (Ms point−120° C.) to Ms point, the temperature T2 is set to a value identical to the temperature T1, and held at the temperature T1. Alternatively, within the range of (Ms point−120° C.) to (Ms point+30° C.), the temperature T2 may be set to a value greater than the cooling-end temperature T1, or may be set to a value less than the cooling-end temperature T1.

If the holding time t3 at the temperature T2 is less than 300 seconds, the progress of the bainite transformation will become insufficient. Thus, concentration of carbon in austenite remaining in an untransformed state during the quenching is not sufficiently promoted. Thus, even if the steel sheet is held at the temperature T2 and then cooled down to room temperature, F/M will remain in a product steel sheet. Consequently, an amount of F/M to be contained in a finally obtained steel sheet cannot be suppressed to 5 area % or less, so that it becomes impossible to improve the hydrogen embrittlement resistance. Therefore, the holding time t3 is set to 300 seconds or more. The holding time t3 is set preferably to 500 seconds or more, more preferably to 700 seconds or more.

An upper limit of the holding time is not particularly limited. However, if the holding time is excessively increased, it is likely that productivity is deteriorated, and retained γ cannot be formed due to precipitation of a sold solution of carbon in the form of carbide, which causes deterioration in ductility, resulting in poor workability. Therefore, it is desirable that the upper limit of the holding time is set to about 1500 seconds.

The $Ac_3$ point and the Ms point may be calculated from the following formulas (a) and (b) which are described in "The Physical Metallurgy of Steels, William C. Leslie" (MARUZEN Co. Ltd., May 31, 1985, p. 273). In the formula (a), [ ] indicates a content (% by mass) of each element, wherein, when an element is not included in a steel sheet, a calculation may be performed by assigning 0 mass % as a content of the element.

$$Ac_3(°\ C.)=910-203\times[C]^{1/2}-15.2\times[Ni]+44.7\times[Si]+31.5\times[Mo]-(30\times[Mn]+11\times[Cr]+20\times[Cu]-700\times[P]-400\times[Al]-400\times[Ti]) \quad (a)$$

$$Ms(°\ C.)=561-474\times[C]-33\times[Mn]-17\times[Ni]-17\times[Cr]-21\times[Mo] \quad (b)$$

The technique of the present invention is suitably applied, particularly, to a thin steel sheet having a sheet thickness of 3 mm or less.

The steel sheet of the present invention obtained in the above manner is suitably usable as a raw material of a component requiring high strength, for example, a seat rail, a body component such as a pillar or a reinforcement member, or a reinforcing component such as a bumper or an impact beam.

Although the present invention will be more specifically described below based on examples, it is understood that the examples are not intended to limit the present invention, but may be implemented while being appropriately changed or modified within a range conformable to the aforementioned and aftermentioned points. Therefore, such changes and modifications should be construed as being included in the scope of the present invention hereinafter defined.

EXAMPLES

Steel having each composition illustrated in the following Tables 1 and 2 (the balance is Fe and inevitable impurities) was vacuum melted to produce a test slab. An $Ac_3$ point and an Ms point were calculated based on each composition illustrated in the Tables 1 and 2 and the formulas (a) and (b). The result is illustrated in the following Tables 3 and 4. In the Tables 3 and 4, respective values of (Ms point−250° C.), (Ms point+30° C.) and (Ms point−120° C.) are illustrated together.

The obtained test slab was subjected to hot rolling and then cold rolling. Subsequently, the rolled slab was subjected to continuous annealing to obtain a steel sheet (sample). Specific conditions of each process are as follows.

After the test slab was held at 1250° C. for 30 munities, the test slab was subject to hot rolling in such a manner that a finish rolling temperature becomes 850° C. Then, the rolled slab was cooled from the finish rolling temperature to a winding temperature of 650° C. at an average cooling rate of 40° C./sec. After winding the cooled slab, the wound slab was held at the winding temperature (650° C.) for 30 minutes, and then cooled in air to room temperature to obtain a hot-rolled steel sheet having a sheet thickness of 2.4 mm. The obtained hot-rolled steel sheet was subjected to pickling to remove a surface scale, and then subjected to cold rolling at a cold reduction of 50% to obtain a cold-rolled steel sheet having a sheet thickness of 1.2 mm. The obtained cold-rolled steel sheet was heated up to each heating temperature (° C.) illustrated in the Tables 3 and 4, and then quenched in such a manner that it is cooled to each temperature T1 (° C.) at each average cooling rate illustrated in the Tables 3 and 4. Subsequently, the cooled slab was subjected to continuous annealing in which the slab is held at each constant temperature T2 (° C.) for each holding time t3 (sec) illustrated in the Tables 3 and 4, to obtain a steel sheet (sample).

Then, a metallographic structure and mechanical characteristics of the obtained sample was checked in the following manner. Further, when it is ascertained that a specific sample has a tensile strength of 1180 MPa or more as a result of checking the mechanical characteristics of each sample, hydrogen embrittlement resistance of the specific sample was checked in the following manner.

Observation of Metallographic Structures

Each sample was cut at a ¼ position of the sheet thickness along a direction parallel to a rolling direction to form a cut surface. The cut surface was subjected to grinding and further electrolytic polishing, and subjected to etching. A metallographic structure of the sample was checked by observing the etched surface using a scanning electron microscope (SEM).

The electrolytic polishing was performed for 15 seconds in a wet process using a solution "Struers A2 (trade name)" produced by Struers Inc. The etching was performed by bringing the cut surface into contact with a solution "Struers A2 (trade name)" produced by Struers Inc, for 1 second.

A photograph of a metallographic structure taken by the SEM was subjected to image analysis to measure each of an area ratio of a parent phase (bainite, bainitic ferrite and tempered martensite) and an area ratio of fresh martensite (F/M). A magnification for the observation was set to ×4000, and a field of view of the observation was set to about 50 μm×50 μm.

The parent phase and the F/M were distinguished from each other based on whether there is Fe-based carbide within a crystal grain. Specifically, a crystal grain in which a white point (or a white line composed of a linear array of continuously connected white points) was observed in the image analysis of the SEM photograph, was determined to be bainite, bainitic ferrite or tempered martensite, and a crystal grain in which no white point (or no white line) was observed in the image analysis of the SEM photograph, was determined to be F/M. Then, an area ratio of each structure was measured. A composition of the white point (or the while line) observed within a crystal grain was analyzed by XDR (X-Ray Diffraction). As a result, it was Fe-based carbide.

A photograph (as a substitute for a drawing) which depicts a metallographic structure of a steel sheet of Sample No. 46, a photograph (as a substitute for a drawing) which depicts a metallographic structure of a steel sheet of Sample No. 38, are illustrated in FIG. 1 and FIG. 2, respectively.

In a metallographic structure of each sample, an area ratio of retained γ was measured by a saturation magnetization method. Specifically, a saturation magnetization (I) of the sample, and a saturation magnetization (Is) of a standard sample subjected to a heat treatment at 400° C. for 15 hours, were measured. Then, a rate of an austenite phase (Vγ) was calculated from the following formula, and the calculated rate was used as an area ratio of retained γ. The measurement of the saturation magnetization was performed at room temperature using a DC magnetization B-H characteristic automatic recorder "model BHS-40" produced by Riken Denshi Co. Ltd., under a condition that a maximum applied magnetization was set to 5000 (Oe).

$$V\gamma=(1-I/Is)\times 100$$

An area ratio of other structure (ferrite, pearlite, etc.) was derived by subtracting the above structures (bainite, bainitic ferrite, tempered martensite, F/M and retained γ) from the entire metallographic structure (100 area %), and a type of structure was specified by SEM observation.

Evaluation of Mechanical Characteristics

As mechanical characteristics of each sample, a tensile test was carried out using a No. 5 test piece defined by JIS Z2201 to measure a yield strength (YS), a tensile strength (TS) and an elongation (El). The test piece was cut out from the sample to allow a longitudinal direction thereof to be aligned with a direction perpendicular to the rolling direction. A result of the measurement is illustrated in the following Tables 5 and 6. In the present invention, when the TS is 1180 MPa or more, the sample is evaluated as high strength (OK), and, when the TS is less than 1180 MPa, the sample is evaluated as lack of strength (NG).

Evaluation of Hydrogen Embrittlement Resistance

A 150 mm×30 mm reed-shaped test piece was cut out from each sample to allow a longitudinal direction thereof to be aligned with a direction perpendicular to the rolling direction, and subjected to bending to allow a bended portion to have a curvature radius (R) of 10 mm. Then, under a condition that the test piece was immersed in a 5% aqueous solution of hydrochloric acid while being loaded with a stress of 1500 MPa (strain is converted to stress using a strain gauge), a time before the occurrence of crack was measured as hydrogen embrittlement resistance of the sample. In the present invention, when the time before the occurrence of crack is 24 hours or more, the sample is evaluated as excellent hydrogen embrittlement resistance (OK), and, when the time before the occurrence of crack is less than 24 hours, the sample is evaluated as poor hydrogen embrittlement resistance (NG). A result of the evaluation is illustrated in the Tables 5 and 6. In the Tables 5 and 6, when the hydrogen embrittlement resistance is excellent, the result is represented by ○. When the hydrogen embrittlement resistance is poor, the time before the occurrence of crack is indicated.

The following can be considered from the Tables 5 and 6.

Each of the samples Nos. 1 to 40 has a tensile strength of 1180 MPa or more, and excellent hydrogen embrittlement resistance.

In contrast, each of the samples Nos. 41 to 50 fails to satisfy both a tensile strength of 1180 MPa or more, and excellent hydrogen embrittlement resistance. Specifically, each of the samples Nos. 41 to 44, 49 and 50 has a tensile strength of less than 1180 MPa, i.e., fails to satisfy the requirement defined by the present invention. Further, each of the samples Nos. 45 to 48 has a tensile strength of 1180 MPa or more, but fails to improve hydrogen embrittlement resistance. Each of the samples Nos. 41 to 50 will be discussed below.

In No. 41, the heating temperature is less than the $Ac_3$ point, so that an amount of formation of ferrite is increased. As a result, an amount of formation of austenite is reduced, and thereby an amount of formation of bainite, bainitic ferrite and tempered martensite is reduced. This causes a lack of strength. In No. 42, the average cooling rate from the heating temperature to the temperature T1 is less than 10° C./sec. Thus, a large amount of ferrite is formed, and thereby an amount of formation of bainite, bainitic ferrite and tempered martensite is reduced, which causes a lack of strength. In No. 43, the cooling-end temperature T1 after the holding is excessively high, i.e., fails to reach the Ms point, which causes a lack of strength. In No. 44, the holding temperature T2 is excessively high, i.e., greater than (Ms point+30° C.), which causes a lack of strength. In No. 45, the cooling-end temperature T1 after the holding is excessively low, i.e., less than (Ms point−250° C.), which causes poor elongation. Moreover, the holding temperature T2 is excessively low, i.e., less than (Ms point−120° C.), which causes deterioration in hydrogen embrittlement resistance. In Nos. 46 to 48, the holding time t3 is excessively short. Thus, the bainite transformation is sufficiently progressed, and thereby a large amount of F/M remains, which causes deterioration in hydrogen embrittlement resistance. In Nos. 49 and 50, the tensile strength is less than 1180 MPa, i.e., does not satisfy the requirement defined by the present invention.

TABLE 1

| | COMPOSITION (mass %) | | | | | | | | | | | | | | |
|---|---|---|---|---|---|---|---|---|---|---|---|---|---|---|---|
| No. | C | Si | Mn | P | S | Al | N | Nb | Ti | Cu | Ni | Cr | Mo | B | Ca, Mg, REM |
| 1 | 0.20 | 1.50 | 2.5 | 0.009 | 0.004 | 0.045 | 0.005 | — | — | — | — | — | — | — | — |
| 2 | 0.16 | 1.50 | 2.9 | 0.008 | 0.003 | 0.044 | 0.005 | — | — | — | — | — | — | — | — |
| 3 | 0.18 | 1.75 | 2.6 | 0.008 | 0.003 | 0.043 | 0.004 | — | — | — | — | — | — | — | — |
| 4 | 0.24 | 1.15 | 2.5 | 0.008 | 0.002 | 0.045 | 0.004 | — | — | — | — | — | — | — | — |
| 5 | 0.21 | 1.35 | 2.6 | 0.008 | 0.004 | 0.045 | 0.004 | — | — | — | — | — | — | — | — |
| 6 | 0.21 | 2.00 | 2.5 | 0.009 | 0.002 | 0.041 | 0.004 | — | — | — | — | — | — | — | — |
| 7 | 0.23 | 1.54 | 1.6 | 0.008 | 0.003 | 0.042 | 0.004 | — | — | — | — | — | — | — | — |
| 8 | 0.21 | 1.55 | 2.0 | 0.008 | 0.003 | 0.044 | 0.004 | — | — | — | — | — | — | — | — |
| 9 | 0.21 | 1.50 | 2.8 | 0.008 | 0.003 | 0.044 | 0.004 | — | — | — | — | — | — | — | — |
| 10 | 0.21 | 1.54 | 2.5 | 0.008 | 0.003 | 0.041 | 0.004 | — | — | — | — | — | — | — | — |
| 11 | 0.20 | 1.54 | 2.5 | 0.008 | 0.003 | 0.044 | 0.004 | 0.05 | — | — | — | — | — | — | — |
| 12 | 0.20 | 1.54 | 2.5 | 0.008 | 0.003 | 0.042 | 0.004 | — | 0.06 | — | — | — | — | — | — |
| 13 | 0.22 | 1.50 | 2.4 | 0.008 | 0.003 | 0.041 | 0.004 | — | — | 0.2 | 0.2 | — | — | — | — |
| 14 | 0.21 | 1.50 | 2.5 | 0.008 | 0.003 | 0.041 | 0.004 | — | — | — | — | 0.5 | — | — | — |
| 15 | 0.21 | 1.45 | 2.4 | 0.008 | 0.003 | 0.044 | 0.004 | — | — | — | — | — | 0.2 | — | — |
| 16 | 0.22 | 1.60 | 2.5 | 0.008 | 0.003 | 0.042 | 0.004 | — | 0.03 | — | — | — | — | 0.0021 | — |
| 17 | 0.20 | 1.52 | 2.5 | 0.008 | 0.003 | 0.041 | 0.004 | — | 0.08 | 0.15 | 0.11 | — | — | — | — |
| 18 | 0.22 | 1.43 | 2.3 | 0.008 | 0.003 | 0.041 | 0.004 | 0.05 | — | 0.12 | 0.11 | — | — | — | — |
| 19 | 0.22 | 1.43 | 2.5 | 0.008 | 0.003 | 0.044 | 0.004 | 0.05 | 0.07 | 0.12 | 0.11 | 0.5 | — | — | — |
| 20 | 0.21 | 1.50 | 2.5 | 0.008 | 0.003 | 0.044 | 0.004 | 0.05 | 0.07 | 0.12 | 0.12 | — | 0.2 | — | — |
| 21 | 0.21 | 1.54 | 2.5 | 0.008 | 0.003 | 0.044 | 0.004 | 0.05 | 0.05 | 0.11 | 0.11 | — | — | 0.0013 | — |
| 22 | 0.22 | 1.54 | 2.5 | 0.008 | 0.003 | 0.042 | 0.004 | 0.05 | 0.08 | 0.12 | 0.10 | — | — | — | — |
| 23 | 0.20 | 1.54 | 2.5 | 0.008 | 0.003 | 0.044 | 0.004 | — | 0.08 | 0.12 | 0.11 | 0.5 | 0.15 | — | — |
| 24 | 0.19 | 1.54 | 2.5 | 0.008 | 0.003 | 0.044 | 0.004 | — | 0.08 | 0.13 | 0.11 | 0.8 | — | 0.0015 | — |
| 25 | 0.21 | 1.54 | 2.5 | 0.008 | 0.003 | 0.041 | 0.004 | 0.04 | 0.05 | — | — | 0.5 | 0.2 | — | — |

TABLE 2

| | COMPOSITION (mass %) | | | | | | | | | | | | | | |
|---|---|---|---|---|---|---|---|---|---|---|---|---|---|---|---|
| No. | C | Si | Mn | P | S | Al | N | Nb | Ti | Cu | Ni | Cr | Mo | B | Ca, Mg, REM |
| 26 | 0.20 | 1.54 | 2.5 | 0.008 | 0.003 | 0.042 | 0.004 | 0.05 | 0.05 | — | — | 0.7 | — | 0.0014 | — |
| 27 | 0.21 | 1.54 | 2.5 | 0.008 | 0.003 | 0.041 | 0.004 | — | 0.07 | — | — | 0.7 | 0.13 | 0.0007 | — |
| 28 | 0.19 | 1.54 | 2.5 | 0.008 | 0.003 | 0.044 | 0.004 | 0.035 | — | 0.3 | 0.2 | 0.8 | 0.13 | — | — |
| 29 | 0.22 | 1.54 | 2.5 | 0.008 | 0.003 | 0.044 | 0.004 | — | 0.03 | 0.28 | 0.25 | 0.4 | — | 0.0025 | — |
| 30 | 0.20 | 1.54 | 2.5 | 0.008 | 0.003 | 0.042 | 0.004 | — | — | — | — | — | — | — | Ca: 0.004, Mg: 0.005, REM: 0.005 |
| 31 | 0.21 | 1.54 | 2.5 | 0.008 | 0.003 | 0.041 | 0.004 | — | — | — | — | — | — | — | — |
| 32 | 0.21 | 1.54 | 2.5 | 0.008 | 0.003 | 0.041 | 0.004 | — | — | — | — | — | — | — | — |
| 33 | 0.18 | 1.75 | 2.6 | 0.008 | 0.003 | 0.043 | 0.004 | — | — | — | — | 0.08 | — | — | — |
| 34 | 0.24 | 1.15 | 2.5 | 0.008 | 0.002 | 0.045 | 0.004 | — | — | — | — | 0.03 | — | — | — |
| 35 | 0.21 | 1.54 | 2.5 | 0.008 | 0.003 | 0.041 | 0.004 | 0.04 | — | — | — | 0.4 | — | — | — |
| 36 | 0.21 | 1.54 | 2.5 | 0.008 | 0.003 | 0.041 | 0.004 | 0.04 | 0.05 | — | — | 0.5 | — | — | — |
| 37 | 0.18 | 1.50 | 2.5 | 0.008 | 0.003 | 0.041 | 0.004 | 0.04 | 0.05 | 0.28 | 0.25 | 0.9 | — | 0.0011 | — |
| 38 | 0.21 | 1.54 | 2.5 | 0.008 | 0.003 | 0.041 | 0.004 | — | — | — | — | — | 0.07 | — | — |
| 39 | 0.21 | 1.54 | 2.5 | 0.011 | 0.003 | 0.041 | 0.004 | — | — | — | — | — | — | — | — |
| 40 | 0.21 | 1.54 | 2.5 | 0.011 | 0.003 | 0.041 | 0.004 | — | — | — | — | — | — | — | — |
| 41 | 0.21 | 1.54 | 2.5 | 0.008 | 0.003 | 0.041 | 0.004 | — | — | — | — | — | — | — | — |
| 42 | 0.21 | 1.54 | 2.5 | 0.008 | 0.003 | 0.041 | 0.004 | — | — | — | — | — | — | — | — |
| 43 | 0.24 | 1.54 | 2.6 | 0.008 | 0.003 | 0.041 | 0.004 | — | — | — | — | — | — | — | — |
| 44 | 0.21 | 1.54 | 2.5 | 0.008 | 0.003 | 0.041 | 0.004 | — | — | — | — | — | — | — | — |
| 45 | 0.21 | 1.54 | 2.5 | 0.008 | 0.003 | 0.041 | 0.004 | — | — | — | — | — | — | — | — |
| 46 | 0.21 | 1.54 | 2.5 | 0.008 | 0.003 | 0.041 | 0.004 | — | — | — | — | — | 0.07 | — | — |
| 47 | 0.21 | 1.54 | 2.5 | 0.008 | 0.003 | 0.041 | 0.004 | — | — | — | — | — | — | — | — |
| 48 | 0.21 | 1.54 | 2.5 | 0.008 | 0.003 | 0.041 | 0.004 | — | — | — | — | — | — | — | — |
| 49 | 0.11 | 1.54 | 2.0 | 0.008 | 0.003 | 0.041 | 0.004 | — | — | — | — | — | — | — | — |
| 50 | 0.21 | 1.55 | 1.4 | 0.008 | 0.003 | 0.041 | 0.004 | — | — | — | — | — | — | — | — |

TABLE 3

| No. | $Ac_3$ (° C.) | Ms (° C.) | Ms − 250 (° C.) | Ms + 30 (° C.) | Ms − 120 (° C.) | HEATING TEMPERATURE(° C.) | AVERAGE COOLING RATE (° C./sec) | T1 (° C.) | T2 (° C.) | t3 (sec) |
|---|---|---|---|---|---|---|---|---|---|---|
| 1 | 835 | 384 | 134 | 414 | 264 | 900 | 30 | 320 | 380 | 1300 |
| 2 | 832 | 389 | 139 | 419 | 269 | 900 | 30 | 300 | 310 | 1300 |
| 3 | 846 | 390 | 140 | 420 | 270 | 900 | 30 | 300 | 310 | 1300 |
| 4 | 810 | 365 | 115 | 395 | 245 | 900 | 30 | 300 | 300 | 1300 |
| 5 | 822 | 376 | 126 | 406 | 256 | 900 | 30 | 320 | 360 | 1300 |
| 6 | 854 | 379 | 129 | 409 | 259 | 900 | 30 | 320 | 380 | 1300 |
| 7 | 855 | 399 | 149 | 429 | 279 | 900 | 30 | 280 | 310 | 1300 |
| 8 | 849 | 395 | 145 | 425 | 275 | 900 | 30 | 280 | 310 | 1300 |
| 9 | 823 | 369 | 119 | 399 | 249 | 900 | 30 | 300 | 380 | 1300 |
| 10 | 832 | 379 | 129 | 409 | 259 | 900 | 30 | 280 | 270 | 1300 |
| 11 | 836 | 384 | 134 | 414 | 264 | 900 | 30 | 320 | 380 | 1300 |
| 12 | 859 | 384 | 134 | 414 | 264 | 900 | 30 | 300 | 370 | 1300 |
| 13 | 824 | 374 | 124 | 404 | 254 | 900 | 30 | 300 | 360 | 1300 |
| 14 | 825 | 370 | 120 | 400 | 250 | 900 | 30 | 320 | 350 | 1300 |
| 15 | 839 | 378 | 128 | 408 | 258 | 900 | 30 | 300 | 320 | 1300 |
| 16 | 845 | 374 | 124 | 404 | 254 | 900 | 30 | 310 | 330 | 1300 |
| 17 | 861 | 382 | 132 | 412 | 262 | 900 | 30 | 310 | 360 | 1300 |
| 18 | 827 | 379 | 129 | 409 | 259 | 900 | 30 | 300 | 330 | 1300 |
| 19 | 845 | 364 | 114 | 394 | 244 | 900 | 30 | 300 | 320 | 1300 |
| 20 | 862 | 373 | 123 | 403 | 253 | 900 | 30 | 280 | 300 | 1300 |
| 21 | 850 | 377 | 127 | 407 | 257 | 900 | 30 | 280 | 300 | 1300 |
| 22 | 859 | 373 | 123 | 403 | 253 | 900 | 30 | 300 | 340 | 1300 |
| 23 | 863 | 370 | 120 | 400 | 250 | 900 | 30 | 290 | 300 | 1300 |
| 24 | 857 | 373 | 123 | 403 | 253 | 900 | 30 | 290 | 300 | 1300 |
| 25 | 853 | 366 | 116 | 396 | 246 | 900 | 30 | 290 | 300 | 1300 |

TABLE 4

| No. | $Ac_3$ (° C.) | Ms (° C.) | Ms − 250 (° C.) | Ms + 30 (° C.) | Ms − 120 (° C.) | HEATING TEMPERATURE(° C.) | AVERAGE COOLING RATE (° C./sec) | T1 (° C.) | T2 (° C.) | t3 (sec) |
|---|---|---|---|---|---|---|---|---|---|---|
| 26 | 847 | 372 | 122 | 402 | 252 | 900 | 30 | 290 | 300 | 1300 |
| 27 | 857 | 364 | 114 | 394 | 244 | 900 | 30 | 290 | 300 | 1300 |
| 28 | 824 | 369 | 119 | 399 | 249 | 900 | 30 | 290 | 290 | 1300 |
| 29 | 830 | 363 | 113 | 393 | 243 | 900 | 30 | 290 | 290 | 1300 |
| 30 | 835 | 384 | 134 | 414 | 264 | 900 | 30 | 320 | 380 | 1300 |
| 31 | 832 | 379 | 129 | 409 | 259 | 900 | 30 | 310 | 310 | 500 |
| 32 | 832 | 379 | 129 | 409 | 259 | 900 | 30 | 320 | 330 | 700 |
| 33 | 846 | 389 | 139 | 419 | 289 | 900 | 30 | 300 | 310 | 1300 |
| 34 | 810 | 364 | 114 | 394 | 264 | 900 | 30 | 300 | 300 | 1300 |
| 35 | 828 | 372 | 122 | 402 | 272 | 900 | 30 | 320 | 380 | 1300 |
| 36 | 847 | 370 | 120 | 400 | 270 | 900 | 30 | 320 | 380 | 1300 |
| 37 | 838 | 374 | 124 | 404 | 274 | 900 | 30 | 260 | 290 | 1300 |
| 38 | 835 | 377 | 127 | 407 | 257 | 900 | 30 | 300 | 300 | 1200 |
| 39 | 834 | 379 | 129 | 409 | 259 | 900 | 30 | 320 | 320 | 400 |
| 40 | 834 | 379 | 129 | 409 | 259 | 900 | 30 | 310 | 310 | 300 |
| 41 | 832 | 379 | 129 | 409 | 259 | 800 | 30 | 320 | 370 | 1300 |
| 42 | 832 | 379 | 129 | 409 | 259 | 900 | 5 | 300 | 370 | 1300 |
| 43 | 823 | 361 | 111 | 391 | 241 | 900 | 30 | 400 | 390 | 1300 |
| 44 | 832 | 379 | 129 | 409 | 259 | 900 | 30 | 320 | 420 | 1300 |
| 45 | 832 | 379 | 129 | 409 | 259 | 900 | 30 | 30 | 30 | 1300 |
| 46 | 835 | 377 | 127 | 407 | 257 | 900 | 30 | 300 | 300 | 60 |
| 47 | 832 | 379 | 129 | 409 | 259 | 900 | 30 | 320 | 380 | 100 |
| 48 | 832 | 379 | 129 | 409 | 259 | 900 | 30 | 320 | 320 | 250 |
| 49 | 873 | 443 | 193 | 473 | 323 | 900 | 30 | 320 | 380 | 1300 |
| 50 | 866 | 415 | 165 | 445 | 295 | 900 | 30 | 320 | 380 | 1300 |

TABLE 5

| | MICROSTRUCTURE (area %) | | | | CHARACTERISTICS | | | |
|---|---|---|---|---|---|---|---|---|
| No. | PARENT PHASE | F/M | RETAINED γ | OTHER | YS(MPa) | TS(MPa) | EI(%) | HYDROGEN EMBRITTLEMENT RESISTANCE |
| 1 | 90 | 0 | 10 | 0 | 812 | 1187 | 12 | ○ |
| 2 | 91 | 0 | 9 | 0 | 925 | 1222 | 11 | ○ |
| 3 | 92 | 0 | 8 | 0 | 941 | 1251 | 11 | ○ |
| 4 | 95 | 0 | 5 | 0 | 1021 | 1449 | 9 | ○ |
| 5 | 90 | 1 | 9 | 0 | 803 | 1182 | 12 | ○ |
| 6 | 89 | 0 | 11 | 0 | 830 | 1232 | 12 | ○ |

TABLE 5-continued

| | MICROSTRUCTURE (area %) | | | | CHARACTERISTICS | | | |
|---|---|---|---|---|---|---|---|---|
| No. | PARENT PHASE | F/M | RETAINED γ | OTHER | YS(MPa) | TS(MPa) | EI(%) | HYDROGEN EMBRITTLEMENT RESISTANCE |
| 7 | 95 | 0 | 5 | 0 | 816 | 1189 | 9 | ○ |
| 8 | 96 | 0 | 4 | 0 | 844 | 1258 | 8 | ○ |
| 9 | 93 | 0 | 7 | 0 | 895 | 1285 | 8 | ○ |
| 10 | 96 | 0 | 4 | 0 | 889 | 1328 | 10 | ○ |
| 11 | 90 | 0 | 10 | 0 | 832 | 1220 | 11 | ○ |
| 12 | 91 | 0 | 9 | 0 | 821 | 1193 | 12 | ○ |
| 13 | 91 | 0 | 9 | 0 | 824 | 1200 | 12 | ○ |
| 14 | 92 | 0 | 8 | 0 | 843 | 1221 | 11 | ○ |
| 15 | 96 | 0 | 4 | 0 | 1032 | 1493 | 8 | ○ |
| 16 | 93 | 0 | 7 | 0 | 890 | 1310 | 9 | ○ |
| 17 | 90 | 0 | 10 | 0 | 826 | 1225 | 12 | ○ |
| 18 | 92 | 0 | 8 | 0 | 861 | 1235 | 11 | ○ |
| 19 | 94 | 0 | 6 | 0 | 1004 | 1454 | 9 | ○ |
| 20 | 96 | 0 | 4 | 0 | 1040 | 1557 | 9 | ○ |
| 21 | 95 | 0 | 5 | 0 | 1025 | 1490 | 10 | ○ |
| 22 | 91 | 0 | 9 | 0 | 889 | 1359 | 11 | ○ |
| 23 | 96 | 0 | 4 | 0 | 1029 | 1478 | 8 | ○ |
| 24 | 96 | 0 | 4 | 0 | 1008 | 1466 | 9 | ○ |
| 25 | 96 | 0 | 4 | 0 | 1043 | 1512 | 7 | ○ |

TABLE 6

| | MICROSTRUCTURE (area %) | | | | CHARACTERISTICS | | | |
|---|---|---|---|---|---|---|---|---|
| No. | PARENT PHASE | F/M | RETAINED γ | OTHER | YS(MPa) | TS(MPa) | EI(%) | HYDROGEN EMBRITTLEMENT RESISTANCE |
| 26 | 94 | 0 | 6 | 0 | 1003 | 1460 | 10 | ○ |
| 27 | 94 | 0 | 6 | 0 | 1055 | 1530 | 7 | ○ |
| 28 | 94 | 0 | 6 | 0 | 1034 | 1516 | 10 | ○ |
| 29 | 95 | 0 | 5 | 0 | 1029 | 1504 | 9 | ○ |
| 30 | 90 | 0 | 10 | 0 | 815 | 1188 | 12 | ○ |
| 31 | 90 | 0 | 10 | 0 | 863 | 1272 | 10 | ○ |
| 32 | 90 | 0 | 10 | 0 | 843 | 1221 | 11 | ○ |
| 33 | 93 | 0 | 7 | 0 | 953 | 1262 | 11 | ○ |
| 34 | 96 | 0 | 4 | 0 | 1034 | 1458 | 9 | ○ |
| 35 | 90 | 0 | 10 | 0 | 843 | 1235 | 11 | ○ |
| 36 | 90 | 0 | 10 | 0 | 854 | 1243 | 11 | ○ |
| 37 | 94 | 0 | 6 | 0 | 1020 | 1455 | 9 | ○ |
| 38 | 92 | 0 | 8 | 0 | 921 | 1373 | 10 | ○ |
| 39 | 88 | 2 | 10 | 0 | 865 | 1241 | 10 | ○ |
| 40 | 86 | 4 | 10 | 0 | 871 | 1259 | 10 | ○ |
| 41 | 70 | 0 | 10 | FERRITE: 20 | 720 | 1051 | 15 | — |
| 42 | 55 | 0 | 5 | FERRITE: 40 | 682 | 920 | 12 | — |
| 43 | 95 | 3 | 2 | 0 | 769 | 989 | 13 | — |
| 44 | 88 | 4 | 8 | 0 | 742 | 1085 | 14 | — |
| 45 | 93 | 6 | 1 | 0 | 915 | 1382 | 4 | 6 |
| 46 | 72 | 20 | 8 | 0 | 874 | 1259 | 9 | 5 |
| 47 | 77 | 14 | 9 | 0 | 841 | 1221 | 9 | 8 |
| 48 | 84 | 6 | 10 | 0 | 821 | 1203 | 11 | 10 |
| 49 | 86 | 0 | 14 | 0 | 646 | 906 | 20 | — |
| 50 | 73 | 0 | 12 | FERRITE: 15 | 731 | 1078 | 17 | — |

As described above in detail, according to one aspect of the present invention, there is provided a high strength steel sheet having excellent hydrogen embrittlement resistance, wherein the steel sheet has a tensile strength of 1180 MPa or more, and satisfies the following conditions: with respect to an entire metallographic structure thereof, bainite, bainitic ferrite and tempered martensite account for 85 area % or more in total; retained austenite accounts for 1 area % or more; and fresh martensite accounts for 5 area % or less (including 0 area %).

In the steel sheet of the present invention, the metallographic structure of the high strength steel sheet having a tensile strength of 1180 MPa or more is adequately controlled to suppress an amount of formation of fresh martensite to 5 area % or less, so that it becomes possible to enhance hydrogen embrittlement resistance of the steel sheet.

A composition of a steel sheet exhibiting a tensile strength of 1180 MPa or more is already widely known (see, for example, the Patent Documents 2 to 4). The present invention is directed to such a high strength steel sheet, and designed to control the metallographic structure in the above manner so as to achieve the object of further enhancing the hydrogen embrittlement resistance.

For example, a particularly preferred composition of the high strength steel sheet of the present invention comprises, in terms of mass %, C: 0.15 to 0.25%, Si: 1 to 2.5%, Mn: 1.5 to 3%, P: 0.015% or less, S: 0.01% or less, Al: 0.01 to 0.1%, N: 0.01% or less, and the balance of Fe and inevitable impurities.

The composition of high strength steel sheet of the present invention may further comprise, as other element, an element satisfying at least one of the following conditions (A) to (E):

(A) Cr: 1% or less (except for 0%) and/or Mo: 1% or less (except for 0%);

(B) B: 0.005% or less (except for 0%);

(C) Cu: 0.5% or less (except for 0%) and/or Ni: 0.5% or less (except for 0%);

(D) Nb: 0.1% or less (except for 0%) and/or Ti: 0.1% or less (except for 0%); and (E) one or more selected from the group consisting of Ca: 0.005% or less (except for 0%), Mg: 0.005% or less (except for 0%) and REM: 0.01% or less (except for 0%).

According to another aspect of the present invention, there is provided a method of producing a high strength steel sheet having excellent hydrogen embrittlement resistance. The method comprises: a quenching step of cooling a steel sheet which consists of any one of the above compositions and has a temperature equal to or greater than an $Ac_3$ point, down to a temperature T1 satisfying the following formula (1), at an average cooling rate of 10° C./sec or more; and a holding step of holding the steel sheet quenched in the quenching step, at a temperature T2 satisfying the following formula (2), for 300 seconds or more.

$$(Ms\ \text{point}-250°\ \text{C.}) \leq T1 \leq Ms\ \text{point} \quad (1)$$

$$(Ms\ \text{point}-120°\ \text{C.}) \leq T2 \leq (Ms\ \text{point}+30°\ \text{C.}) \quad (2)$$

The method of the present invention makes it possible to reliably produce a high strength steel sheet having excellent hydrogen embrittlement resistance.

INDUSTRIAL APPLICABILITY

The high strength steel sheet of the present invention is suitably usable as a raw material of a component requiring high strength, for example, a seat rail, a body component such as a pillar or a reinforcement member, or a reinforcing component such as a bumper or an impact beam, in an automobile.

What is claimed is:

1. A high strength steel sheet, comprising:

with respect to an entire metallographic structure thereof, bainite, bainitic ferrite and tempered martensite of 85 area % or more in total;

retained austenite of 1 area % or more; and fresh martensite of 2 area % or less, wherein the high strength steel sheet has a tensile strength of 1180 MPa or more and an elongation characteristics of 7% or more, and the high strength steel comprises by mass:

C: 0.15 to 0.25%;

Si: 1 to 2.5%;

Mn: 1.5 to 3%;

P: 0.015% or less;

S: 0.01% or less;

Al: 0.01 to 0.1%;

N: 0.01% or less; and the balance is Fe and inevitable impurities.

2. The high strength steel sheet of claim 1, further comprising by mass at least one selected from the group consisting of:

Cr: 1% or less, excluding 0%, and

Mo: 1% or less, excluding 0%.

3. The high strength steel sheet of claim 1, further comprising by mass:

B: 0.005% or less, excluding 0%.

4. The high strength steel sheet of claim 1, further comprising by mass at least one selected from the group consisting of:

Cu: 0.5% or less, excluding 0%, and

Ni: 0.5% or less, excluding 0%.

5. The high strength steel sheet of claim 1, further comprising by mass at least one selected from the group consisting of:

Nb: 0.1% or less, excluding 0%, and

Ti: 0.1% or less, excluding 0%.

6. The high strength steel sheet of claim 1, further comprising by mass: one or more selected from the group consisting of Ca: 0.005% or less, excluding 0%, Mg: 0.005% or less, excluding 0%, and REM: 0.01% or less, excluding 0%.

7. The high strength steel sheet of claim 1, wherein the bainite, bainitic ferrite and tempered martensite account for 90 area % or more, in total, with respect to the entire metallographic structure.

8. The high strength steel sheet of claim 1, wherein the retained austenite accounts for 4 area % or more and 13 area % or less of the entire metallographic structure.

9. The high strength steel sheet of claim 1, wherein the fresh martensite accounts for 0 area % of the entire metallographic structure.

10. The high strength steel sheet of claim 1, which has a tensile strength of 1557 MPa or less.

11. The high strength steel sheet of claim 1, further comprising by mass:

Cu: 0.20% or less.

12. The high strength steel sheet of claim 11, further comprising by mass:

Mo: 0.13% or less.

13. The high strength steel sheet of claim 12, wherein the high strength steel sheet does not comprise Cu or Mo.

14. A method of producing the high strength steel sheet of claim 1, the method comprising:

cooling the high strength steel sheet from a temperature equal to or greater than an $Ac_3$ point, down to a temperature T1 satisfying formula (1), at an average cooling rate of 10° C./sec or more, thereby obtaining a quenched steel sheet; and holding the quenched steel sheet at a temperature T2 satisfying formula (2), for 300 seconds or more, $$(Ms\ \text{point}-250°\ \text{C.}) \leq T1 \leq Ms\ \text{point} \quad (1)$$

$$(Ms\ \text{point}-120°\ \text{C.}) \leq T2 \leq (Ms\ \text{point}+30°\ \text{C.}) \quad (2).$$

15. The method of claim 14, wherein the quenched steel sheet is held at the temperature T2 for 500 seconds or more.

16. The method of claim 14, wherein the quenched steel sheet is held at the temperature T2 for 700 seconds or more.

* * * * *